United States Patent [19]

Satoh et al.

[11] Patent Number: 4,968,389

[45] Date of Patent: Nov. 6, 1990

[54] METHOD OF FORMING A COMPOSITE FILM OVER THE SURFACE OF ALUMINUM MATERIALS

[75] Inventors: Kazuaki Satoh; Kanji Nagashima, both of Kawasaki, Japan

[73] Assignee: Fujitsu Limited, Kawasaki, Japan

[21] Appl. No.: 220,989

[22] Filed: Jul. 18, 1988

Related U.S. Application Data

[63] Continuation of Ser. No. 924,845, filed as PCT JP86/0047 on Feb. 6, 1986, published as WO86/04618 on Aug. 14, 1986.

[30] Foreign Application Priority Data

| | | | |
|---|---|---|---|
| Feb. 6, 1985 | [JP] | Japan | 60-19832 |
| Feb. 6, 1985 | [JP] | Japan | 60-19833 |
| Feb. 8, 1985 | [JP] | Japan | 60-21818 |

[51] Int. Cl.[5] ..... C25D 11/04; C25D 11/22

[52] U.S. Cl. ..... 204/15; 204/376; 204/38.3; 204/42

[58] Field of Search ..... 204/38.3, 42, 37.6, 204/15

[56] References Cited

U.S. PATENT DOCUMENTS

| | | | |
|---|---|---|---|
| 3,915,811 | 10/1975 | Tremmel et al. | 204/33 |
| 3,962,049 | 6/1976 | Ueki | 204/35 N |
| 4,394,415 | 7/1983 | Tsuda | 428/332 |
| 4,548,682 | 10/1985 | Yoshida et al. | 204/35.1 |

FOREIGN PATENT DOCUMENTS 258230 3/1963 Australia .

OTHER PUBLICATIONS

F. A. Lowenheim, *Electroplating,* McGraw-Hill Book Co., New York, 1978, pp. 12-16, 465-467.

F. A. Lowenheim, Electroplating, McGraw-Hill Book Co., New York, 1978, pp. 211-212, 460-464.

S. Wernick & R. Pinner, The Surface Treatment and Finishing of Aluminum, Robert Draper Ltd., Teddington, 1964, pp. 260-269.

*Primary Examiner*—John F. Niebling
*Assistant Examiner*—William T. Leader
*Attorney, Agent, or Firm*—Staas & Halsey

[57] ABSTRACT

A method of forming a coposite film over the surface of aluminum materials, for forming an aluminum oxide film over the surface of an aluminum material, and metal deposits in the aluminum oxide film so as to connect electrically with the aluminum material, in which a voltage is applied to the aluminum material immersed in a sulfuric acid solution to form an aluminum oxide film having pores over the surface of the aluminum material; then the voltage is dropped sharply to near zero while the aluminum material is immersed in the sulfuric acid solution, and a voltage of approximately 0.1 V or less is applied to the aluminum material to dissolve the aluminum oxide film forming the bottoms of the pores; and then the aluminum material coated with the aluminum oxide film is nickel-plated through electroplating to form nickel deposits in the pores of the aluminum oxide film so that the nickel deposts connect electrically with the aluminum material.

4 Claims, 7 Drawing Sheets

METHOD OF FORMING A COMPOSITE FILM OVER THE SURFACE OF ALUMINUM MATERIALS

This is a continuation of co-pending application Ser. No. 924,845, filed on Oct. 6, 1986, now abandoned.

TECHNICAL FIELD

The present invention relates to a method of forming a highly corrosion-resistant and conductive film having a high hardness over the surface of aluminum materials.

BACKGROUND ART

Conventionally cases for electronic computers and communication equipments are made of iron materials and the surfaces of the cases finished by a surface treatment, such as galvanizing, nickel plating or coating with a conductive paint, for electromagnetic shielding and electrostatic shielding.

On the other hand, a light material produced by coating the surface of an aluminum material with a highly corrosion-resistant aluminum oxide film has become known by the trade name "ALUMITE". A technique of nickel plating an aluminum oxide film formed over the surface of an aluminum material for making the aluminum oxide film conductive has been published ("Electrodeposition of Nickel and Zinc in Microscopic Pores in Anode-oxidized Aluminum Films", Fukuda and Fukushima, Kinzoku Zairyo Gijutsu Kenkyu-sho, Kinzoku Hyomen Gijutsu, 33, 5 (1982)). According to this published paper, ten to twenty minutes after forming a carbon electrode and a galvanic cell by applying a voltage of 20 V for thirty minutes to an aluminum material dipped in a 98 g/l sulfuric acid solution of 30° C, decreasing the voltage from 20 V to 0.08 V in four minutes, and maintaining the voltage at 0.08 V for thirteen minutes, the aluminum material is electroplated with nickel at a current density of 0.5 $A/dm^2$.

In plating cases for electronic computers or the like by a conventional plating technique, faulty plating is liable to occur in the inner corners of square structures, such as square pipes. Galvanized cases have problems in that whiskers, namely, hairly crystals, grow with time and the whiskers short-circuit the electronic parts contained in the cases. Coatings of conductive paint are incapable of high corrosion resistance, and allow rusting and the adhesion of waste fibers and dust in the environment onto the surface of the coated cases, and entail troubles attributable to conductive waste fibers falling on the electronic parts contained in the coated cases.

The above-mentioned known method of nickel-electro-plating an aluminum oxide film requires a long plating time, and is incapable of forming a practically satisfactory corrosion-resistant and conductive film due to sporing, namely, a phenomenon in which the explosion of hydrogen occurs in minute pores in the aluminum oxide film during the plating process.

It is the principal object of the present invention to solve the above-mentioned problems, to provide a method of forming a composite film over the surface of aluminum materials by forming an aluminum oxide film over the surface of aluminum materials and plating the aluminum oxide film with nickel in a short plating time without entailing sporing, to produce a practically applicable, corrosion-resistant, conductive light member, and to enable the application of this member for constructing cases for electronic computers.

The contacts and terminals of electronic parts are formed of metals, such as aluminum, and are plated with gold to reduce the resistance to the least possible extent. In the conventional gold-plating process, the surface of an aluminum material is plated with nickel by an ordinary process, and then the nickel-plated surface is plated with gold. In the gold-plating process, the aluminum material as a cathode and soluble gold as an anode are immersed in a gold cyanide bath, and the aluminum material and the soluble gold are connected to a DC power supply for gold-plating.

In the conventional method of gold-plating the surface of an aluminum material, defects in the plated film, such as blisters, are liable to be caused by pin holes and other defects in the surface of the aluminum material, and a large amount of gold must be deposited over the surface of the aluminum material to provide the surface with a satisfactory conductivity, which increases the cost of plating the aluminum material.

Furthermore, the above-mentioned known method of electroplating an aluminum oxide film with nickel requires a long plating time, and has difficulty in practical application due to its tendency to cause sporing, namely, the explosion of hydrogen gas in the minute pores in the aluminum oxide film.

It is another object of the present invention to solve the above-mentioned problems and to provide a method of gold-plating aluminum materials using a lesser amount of gold and capable of forming an nondefective plated gold film, in which a corrosion-resistant, conductive composite film of oxide aluminum and nickel is formed over the surface of an aluminum material in a short plating time without causing sporing, the composite film is gold-plated, and then pores in the aluminum oxide film are sealed.

In order to construct cases for electronic equipment in a light-weight construction and to harden the surface of such cases, an aluminum material coated with a hard anodic oxidation coating of chromium or a hard anodic oxidation coating of chromium is used for constructing the cases.

The conventional aluminum member coated with a hard anodic oxidation coating cannot be coated with a hard paint coating. Accordingly, the plated surface appears only in the intrinsic color of the plated chromium or rhodium, namely, chrome black or the color of chromium, or the color of rhodium, and hence it is impossible to finish the surface of the hard member in a desired color.

Furthermore, the above-mentioned known method of electroplating an aluminum oxide film with nickel requires quite a long plating time and is subject to sporing, namely, the explosion of hydrogen gas in minute pores in the aluminum oxide film, during the plating process, and hence the practical application of this known method has been difficult.

It is a further object of the present invention to solve the above-mentioned problems and to provide a method of dyeing a hard anodic oxidation coating, capable of dyeing the plated surface of aluminum materials in a desired color, in which a corrosion-resistant, conductive, composite film of aluminum oxide and nickel is formed in a short plating time without causing sporing, a hard anodic oxidation coating is formed over the aluminum material coated with the composite film, and then the aluminum material coated with the composite film and the hard anodic oxidation coating is immersed in a dye solution.

DISCLOSURE OF THE INVENTION

In order to achieve the principal object of the invention, the present invention provides a method of forming a composite film over the surface of aluminum materials, for forming an aluminum oxide film over the surface of an aluminum material, and deposits of metal electrically connecting with the aluminum material, which comprises the steps of: forming an aluminum oxide film having pores over the surface of an aluminum material by applying a voltage to the aluminum material in a sulfuric acid solution; sharply dropping the voltage to near zero and applying a voltage of approximately 0.1 V or less to the aluminum material to dissolve the aluminum oxide film forming the bottoms of the pores; and nickel-plating the aluminum material coated with the aluminum oxide film to deposit nickel in the pores of the aluminum oxide film so that the nickel deposits connect electrically with the aluminum material.

An aluminum oxide film having an optimum shape not causing sporing in the nickel-plating process is formed over the surface of an aluminum material, barriers in the bottoms of the pores of the aluminum oxide film can be uniformly and surely dissolved, and nickel deposits in the pores connect electrically with the aluminum material, when voltage is applied to the aluminum material in a sulfuric acid solution of a predetermined condition under the above-mentioned processing conditions.

In order to achieve the principal and second objects of the invention, the present invention provides a method of forming an aluminum oxide film over the surface of an aluminum material and gold-plating the aluminum oxide film, in a preferred embodiment, which comprises the steps of: applying a voltage to an aluminum material in a sulfuric acid solution; sharply dropping the voltage to near zero and applying a voltage of approximately 0.1 V or less to the aluminum material; nickel-plating the surface of the aluminum material by electroplating; gold-plating the nickel-plated aluminum material; and sealing pores in the aluminum oxide film with a nickel acetate solution.

An aluminum oxide film having an optimum shape not causing sporing in the nickel-plating process is formed over the surface of an aluminum material by applying a voltage to the aluminum material under the above-mentioned conditions in a sulfuric acid solution of a predetermined condition, and nickel is deposited by electroplating in the pores at an appropriate surface precipitation rate so that the nickel deposits connect with the aluminum material. A gold film is formed by gold-plating over the nickel deposits formed in the pores of the aluminum oxide film formed over the surface of the aluminum material.

In order to achieve the principal and third objects of the invention, the present invention provides a method of dyeing an aluminum material coated with a hard anodic oxidation coating formed over the surface of the aluminum material, in an embodiment which comprises the steps of: applying a voltage to an aluminum material in a sulfuric acid solution; sharply dropping the voltage to near zero and applying a voltage of approximately 0.1 V or less to the aluminum material; nickel-plating the aluminum material; subjecting the nickel-plated aluminum material to a hard anodic oxidation process; immersing the aluminum material in a dye solution to impregnate the pores in the film coating the aluminum material; and sealing the pores by treating the coated and dyed aluminum material with a nickel acetate solution.

An aluminum oxide film having an optimum shape not causing sporing in the nickel-plating process is formed over the surface of an aluminum material and barriers forming the bottoms of pores in the aluminum oxide film are dissolved uniformly and surely by applying a voltage to the aluminum material under the above-mentioned conditions in a sulfuric acid solution of a predetermined condition, and then a hard anodic oxidation coating is formed over the nickel deposits exposed on the surface of the aluminum oxide film through hard anodic oxidation. After the hard anodic oxidation process, the coated aluminum material is immersed in a dye solution of a desired color to impregnate the pores of the aluminum oxide film with the dye solution, so that the coated surface of the aluminum material is colored in the desired color without covering the hard anodic oxidation coating.

BEST MODE FOR CARRYING OUT THE INVENTION

Figure 1A:
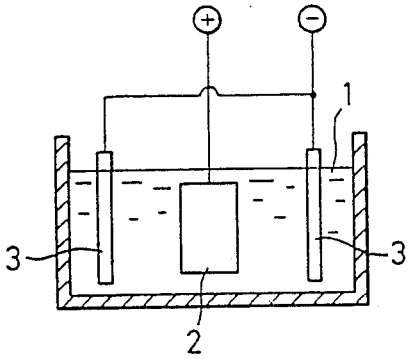
FIG. 1*a* to 1*d* are illustrations of assistance in explaining a method according to the present invention, showing the processes of the method in sequence.

FIGS. 1*a* to 1*d* are illustrations of assistance in explaining a method according to the present invention, showing the processes of the method in sequence. As illustrated in FIG. 1*a,* an aluminum material 2 and carbon electrodes 3 are immersed in a sulfuric acid solution 1 having a concentration in the range of 50 to 80 g/l, and a voltage of 20 V is applied between the aluminum material 2 as an anode and the carbon electrodes 3 as cathodes. The temperature of the sulfuric acid solution is maintained at 30 ±2° C. In ten minutes, an aluminum oxide ($Al_2O_3$) film 8 is formed over the surface of the aluminum material 2 as illustrated in FIG. 2*a.* When observed from above, the aluminum oxide film 8 consists of a plurality of hexagonal cells 8b arranged in a honey-comb arrangement, not shown, and each having a pore 9. A barrier 8a forming the bottom of each cell 8b completely covers the surface of the aluminum material 2. Each cell 8b is approximately 1600Å in outside diameter, approximately 500Å in inside diameter, and approximately 10 μm in height.

Figure 4A:
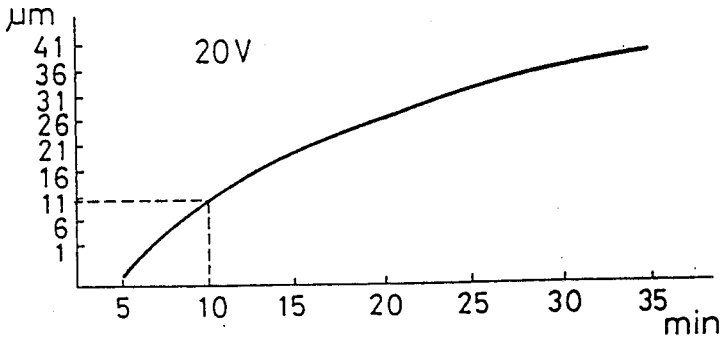
FIGS. 4*a* to 4*c* are graphs showing the variation of film thickness with time for voltage in the aluminum oxide film forming process of a method according to the present invention.
Figure 4B:
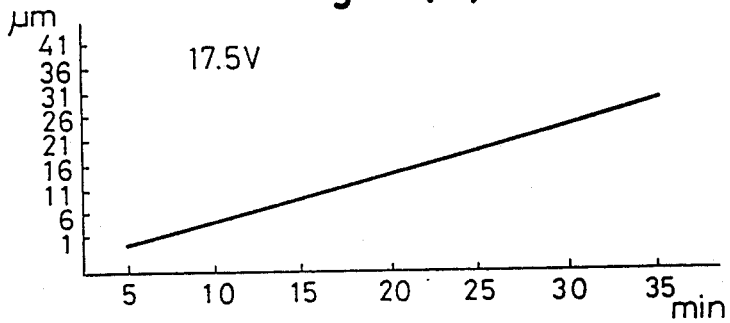
Figure 4C:
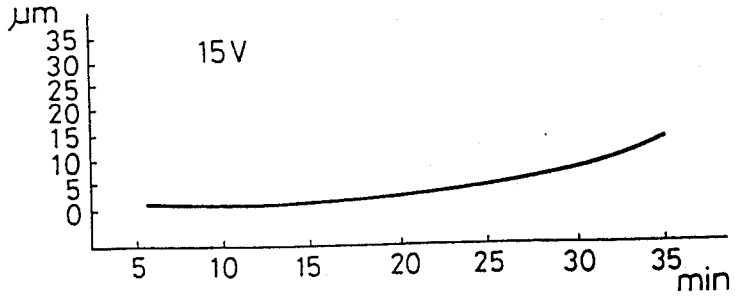

The thickness of the aluminum oxide film 8, namely, the height of the cell 8b, is dependent on the duration of voltage application. FIGS. 4a, 4b, and 4c show the variations of the thickness of the aluminum oxide film 8 with time for voltages of 20 V, 17.5 V, and 15 V, respectively. In this embodiment, an aluminum oxide film approximately 10 μm in thickness is formed. A thickness of 10 μm or above makes satisfactory permeation of the plating solution into the cells in the nickel-plating process difficult, causing faulty plating. An aluminum oxide film having an excessively small thickness, for example, 5 μm or less, has insufficient strength and such a thin aluminum oxide film is not preferable from the viewpoint of practical application. An appropriate thickness is determined according to the purpose. The voltage and the duration of voltage application are selected appropriately to obtain an aluminum oxide film having a desired thickness. According to the present invention, the thickness is approximately 10 μm to give a sufficient strength to the aluminum oxide film and to achieve satisfactory plating in the subsequent plating process. The voltage can be selected in the range of 15 to 20 V, and the duration can be selected in the range of 10 to 30 min (preferably, 10 to 20 min). An excessively low voltage, for example, 13 V or below, is unable to form any aluminum oxide film at all, and a voltage of 20 V or above is unable to form a satisfactory aluminum oxide film. In this embodiment, a voltage of 20 V is applied for ten minutes to form cells approximately 10 μm in thickness (indicated by broken lines in FIG. 4a).

After thus forming the aluminum oxide film 8, the voltage is dropped sharply from 20 V to zero or to near zero, and then a low voltage of 0.1 V or below is applied for 10 to 15 min. Consequently, the barriers 8a of the cells 8b of the aluminum oxide film 8 are dissolved to allow the pores 9 communicate with the aluminum material 2. Actually, very thin barriers having a thickness according to the low voltage are formed, but the very thin barriers are electrolyzed and removed completely in the subsequent nickel-plating process. Accordingly, the lower the low voltage, the better the result.

Sharply dropping the voltage to near zero, as compared with gradually dropping the voltage, enables uniform dissolution and removal of the barriers of the cells.

Figure 1B:
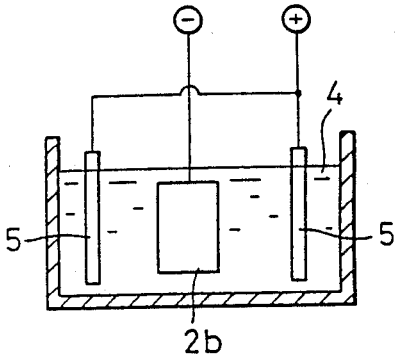
Figure 2A:
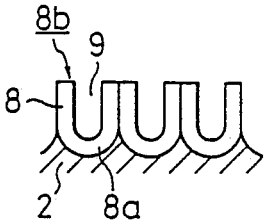
FIG. 2*a* to 2*e* are illustrations of assistance in explaining the variation of an aluminum oxide film formed over the surface of an aluminum material with the progress of the processes of FIGS. 1*a* to 1*d;*
Figure 2B:
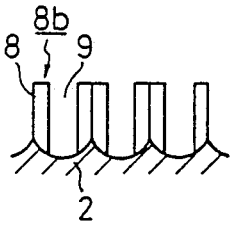
Figure 2C:
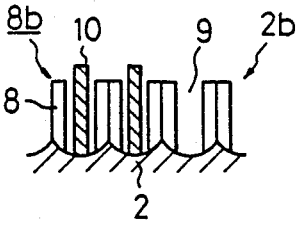

The aluminum material 2 coated with the aluminum oxide film 8 having the bottomless pores 9 formed by dissolving the barriers is immersed in a nickel-plating solution 4 as shown in FIG. 1b for nickel-plating employing the aluminum material 2 as a cathode and nickel electrodes 5 as cathodes. During the nickel-plating process, nickel deposits 10 form in the pores 9 of the cells of the aluminum oxide film 8 (FIG. 2c). The plating voltage is in the range of 0.4 to 1 V, while the current density is in the range of 0.15 to 0.8 $Ad/m^2$. During the nickel-plating process, sporing does not occur at all. At the end of the nickel-plating process, the nickel deposits 10 connecting with the aluminum material 2 form over the surfaces of approximately 50% of the cells 8b in the aluminum oxide film 8 of the nickel-plated aluminum material 2b. Nickel is not deposited at all or is deposited in a thickness less than the height of the cells in the other 50% of the cells 8b. The deposition of nickel so that the nickel deposits 10 project from the surfaces of approximately 50% of the cells enables the internal aluminum material coated with the insulating aluminum oxide film 8 to connect electrically with the exterior in a satisfactory condition.

Figure 1C:
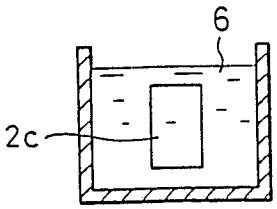
Figure 2D:
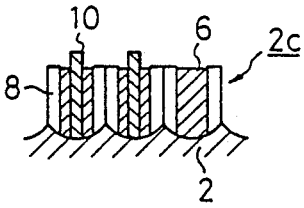

Subsequent to the nickel-plating process, the nickel-plated aluminum material 2b is immersed in a dye solution 6 as shown in FIG. 1c to color the nickel-plated aluminum material 2b in a desired color. When the nickel-plated aluminum material 2b is immersed in the dye solution 6, the dye solution 6 permeates the pores 9 in the aluminum oxide film 8 so that the surface of the aluminum oxide film 8 is colored in a desired color (FIG. 2d). This dyeing process may be omitted.

Figure 1D:
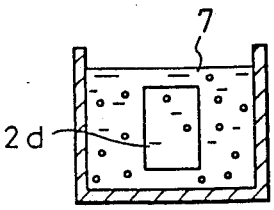
Figure 2E:
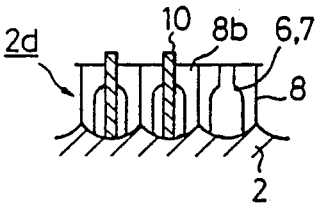

Then, as illustrated in FIG. 1d, the dyed aluminum material 2c is immersed in a sealing solution 7 to obtain a sealed aluminum material 2d, namely, an aluminum material coated with a nickel-plate aluminum oxide film having pores sealed by the agency of the sealing solution. The sealing solution 7 contains 5 g/l nickel acetate and 5 g/l boric acid. The sealing process is carried out at a temperature in the range of 60 to 80° C. in approximately twenty minutes. During the sealing process, nickel hydroxide ($Ni(OH)_2$) produced by the hydrolysis of nickel acetate permeates the cells 8b of the aluminum oxide film 8, and thereby the corrosion of the surface of the aluminum material is prevented despite a great difference between the ionization tendency of aluminum and nickel. As illustrated in FIG. 2e, the surface portions of the cells 8b containing the dye and nickel hydroxide are caused to expand, so that the pores from which the nickel deposits 10 are projecting are sealed and the openings of the pores from which the nickel deposit 10 is not projecting are narrowed.

It is desirable to complete the sealing by a sealing process using boiling water at 98° C. after the sealing process using nickel acetate.

Figure 3:
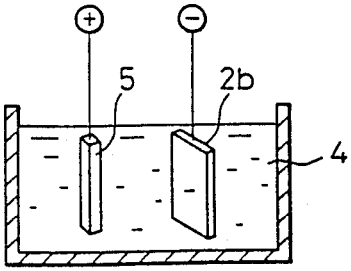
FIG. 3 is an illustration of assistance in explaining another exemplary nickel plating process in a method according to the present invention.

The exterior of the door or the like of the case of an electronic computer requires coloring treatment while the interior of the same requires conductivity for electromagnetic shielding and grounding. To obtain a plate material for such a door or the like, a plate (an aluminum material) 2b to be plated is disposed with only one surface thereof facing the nickel electrode 5 for electroplating, as illustrated in FIG. 3, when nickel-plating the plate 2b after dissolving the bottom barriers of the pores in the aluminum oxide film coating the plate 2b. In this electroplating process, nickel is deposited only in the pores in the aluminum oxide film coating one surface of the plate 2b and no nickel is deposited in the pores in the aluminum oxide film coating the other surface of the plate 2b. When the thus nickel-plated plate is immersed in a dye solution, the aluminum oxide film not having a nickel deposit is impregnated effectively with the dye solution in a desired color. On the other hand, since the nickel deposit is exposed on the surface of the nickel-plated aluminum oxide film the surface of the plate coated with the nickel-plated aluminum oxide is conductive also after being colored, and hence any particular treatment to make the surface conductive for grounding is unnecessary.

In the foregoing embodiment, sulfuric acid is used as an oxidizing agent for forming the aluminum oxide film because sulfuric acid has stable characteristics and is inexpensive; the concentration of sulfuric acid is in the range of 50 to 80 g/l because, when the sulfuric acid concentration is less than 50 g/l, selective anodic oxidation occurs, and particularly when the material is an alloy, spots or stains form over the surface of the material. On the other hand, when the sulfuric concentration is greater than 80 g/l, the CR ratio (weight of the film produced/weight of aluminum dissolved) becomes invariable even when the current density is in the range of 1 to 4 A/dm$^2$, and the conductivity of the electrolytic solution decreases as the concentration increases. The preferable temperature of the sulfuric acid solution for forming the aluminum oxide film is in the range of 30 ±2° C. to form a hard film at an ordinary temperature without cooling, because a temperature above the range softens the film excessively. The voltage and time conditions for the electrolysis for forming the aluminum oxide film are 20 volts and ten minutes to limit the thickness of the film (height of the cells) to a value on the order of 10 μm at a maximum. When removing the barriers forming the bottom of the pores in the aluminum oxide film the voltage is dropped sharply from 20 volts to zero, and then a voltage of 0.1 V is applied to the aluminum material for ten to fifteen minutes for the following reasons. The thickness of the barriers is dependent on the anodic oxidation voltage and is on the order of 14 Å per 1 V bath voltage. Since the bath voltage in carrying out the method of the present invention is 20 volts, barriers having a thickness on the order of 280 Å are formed. In order to sharply stop the further growth of the barriers beyond 280 Å, the voltage is dropped to near zero, and then the electrolysis is continued for a sufficient time at a very low voltage to reduce the thickness of the barriers to 3 Å or less including zero. At the moment when the voltage is dropped to zero, the barriers are not yet removed. The voltage in the range of 0.4 to 1 V for nickel-plating is an optimum voltage condition for nickel plating the aluminum material coated with the aluminum oxide film having pores from which the barriers have been removed. When the voltage is below 0.4 volts, nickel is not deposited, and when the voltage is above 1 volt, sporing occurs.

As apparent from the foregoing description, this method of forming a composite film over the surface of aluminum materials according to the present invention is able to form a highly corrosion-resistant and conductive composite film over the surface of an aluminum material in a short time without causing sporing, and the aluminum material coated with such a composite film is capable of application to highly corrosion-resistant, conductive, lightweight members which are used for forming highly corrosion-resistant and lightweight cases having conductive surfaces for electronic computers and electronic equipment without entailing troubles accompanying the conventional surface treatment, such as galvanizing, nickel-plating or conductive coating. Furthermore, according to the present invention, the amount of nickel deposited in the nickel-plating process is approximately one-fiftieth of the amount of nickel required for the conventional nickel-plating process, and hence the present invention reduces the cost of nickel-plating.

Figure 5A:
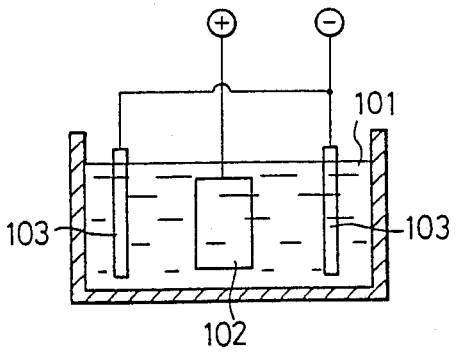
FIGS. 5*a* to 5*d* are illustrations of assistance in explaining a method, in a second embodiment, according to the present invention, showing the process of the method in sequence.

FIG. 5*a* to 5*d* are illustrations of assistance in explaining a method, in a second embodiment according to the present invention, showing the process of the method in sequence. As illustrated in FIG. 5*a*, an aluminum material 102 and carbon electrodes 103 are immersed in a sulfuric acid solution of a concentration in the range of 50 to 80 g/l, and then a voltage of 20 V is applied between the aluminum material 102 as an anode and the carbon electrodes 103 as cathodes. The temperature of the sulfuric acid solution is maintained at 30±2° C. In ten minutes, an aluminum oxide ($Al_2O_3$) film 110 is formed over the surface of the aluminum material 102 as shown in FIG. 6*a*. When observed from above, the aluminum oxide film 110 consists of a plurality of hexagonal cells 110*b* arranged in a honeycomb arrangement, not shown, and each having a pore 111. A barrier 110*a* forming the bottom of each pore 110*b* completely covers the surface of the aluminum material 102. Each cell 110*b* is approximately 1600 Å in outside diameter, 500 Å in inside diameter, and approximately 10 μm in height.

Figure 6A:
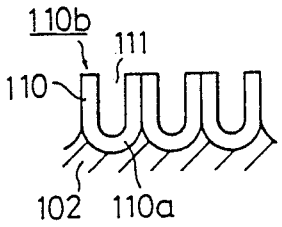
FIGS. 6*a* to 6*e* are illustrations of assistance in explaining the variation of an aluminum oxide film formed over the surface of an aluminum material with the progress of the processes of FIGS. 5*a* to 5*d;*
Figure 6B:
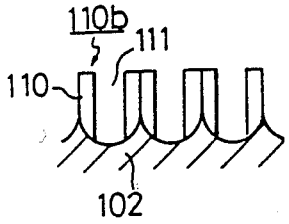

After thus forming the aluminum oxide film 110, the voltage is dropped sharply from 20 V to zero, and then a voltage of 0.1 V is applied for ten to fifteen minutes. Consequently, the barriers 110*a* forming the bottoms of the cells 110*b* are dissolved to allow the pores 111 to connect with the aluminum material 102 as illustrated in FIG. 6*b*.

Figure 5B:
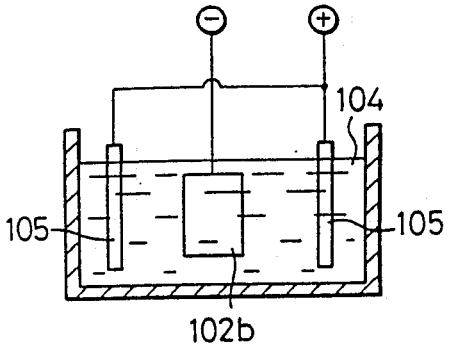
Figure 6C:
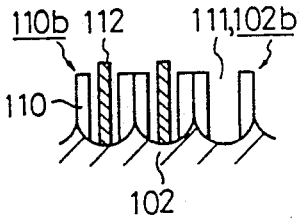

The aluminum material 102 coated with the aluminum oxide film 110 having the bottomless pores 111 is immersed in a nickel-plating solution 104 for nickel-plating employing the aluminum material 102 as a cathode and nickel electrodes 105 as anodes as illustrated in FIG. 5*b*. During the nickel-plating process, nickel deposits 112 form in the pores 111 in the aluminum oxide film 110 (FIG. 6*c*). The plating voltage is in the range of 0.4 to 1 V, and the current density is in the range of 0.15 to 0.8 A/dm$^2$. During the nickel-plating process, sporing does not occur at all. At the end of the nickel-plating process, the nickel deposits 112 connecting with the aluminum material 102 form over the surfaces of approximately 50% of the cells 110*b* in the aluminum oxide film 110. Nickel is not deposited at all or is deposited in the thickness less than the height of the cells in the other 50% of the cells 110*b*. The deposition of nickel so that the nickel deposits 112 project from the surfaces of approximately 50% of the cells 110*b* enables the internal aluminum material 102 coated with the insulating aluminum oxide film 110 to connect electrically with the exterior in a satisfactory condition.

Figure 5C:
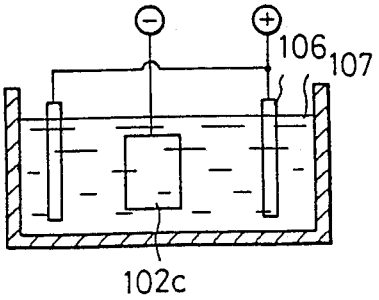
Figure 6D:
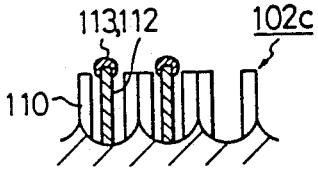

Subsequent to the nickel-plating process, the nickel-plated aluminum material 102*b* and anodes 106 (gold, platinum or hard carbon) are immersed in a gold-plating solution 107 as shown in FIG. 5*c* for gold-plating the nickel-plated aluminum material 102*b* to obtain a gold-plated aluminum material 102*c*. The gold-plating solution 107 contains $KAu(CN)_2$ as the principal solute. The gold-plating solution 107 is prepared by adding ammonia to gold chloride, and by dissolving the precipitate in potassium cyanide. In the gold-plating process, gold deposits 113 form over the top surfaces of the nickel deposits 112 exposed on the surface of the aluminum oxide film 110 as shown in FIG. 6*d*.

Figure 5D:
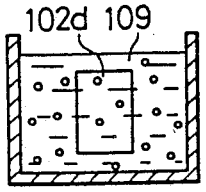
Figure 6E:
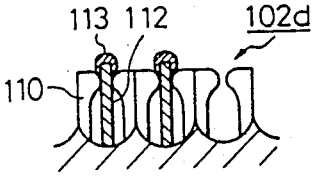

Then, as illustrated in FIG. 5*d*, the gold-plated aluminum material 102*c* is immersed in a sealing solution 109 for sealing treatment to obtain a sealed aluminum material 102*d*, namely, an aluminum material coated with a nickel-plated and gold-plated aluminum oxide film having pores sealed by the agency of the sealing solution. The sealing solution is a mixture containing 5 g/l nickel acetate and 5 g/l boric acid. The sealing treatment is carried out at a temperature in the range of 60 to 80° C. in approximately twenty minutes. During the sealing treatment, nickel hydroxide ($Ni(OH)_2$) produced by the hydrolysis of nickel acetate permeates the cells 110*b* of the aluminum oxide film 110, and thereby the corrosion of the surface of the aluminum material is prevented despite the tendency of the combination of aluminum and nickel to form a battery due to the great difference between in the ionization tendencies of aluminum and nickel. As illustrated in FIG. 6*e*, the sealing treatment caused the surface portions of the cells 110*b* containing nickel hydroxide to expand, so that the pores from which the nickel deposits 112 are projecting are sealed and the openings of the pores from which the nickel deposit 112 is not projecting the narrowed.

It is desirable to complete the sealing by a sealing treatment using boiling water at 98° C. after the sealing treatment using nickel acetate.

As is apparent from the foregoing description, this method of forming a composite film over the surface of aluminum material, in the second embodiment, according to the present invention forms a highly corrosion-resistant, conductive, composite film composed of aluminum oxide and nickel over an aluminum material in a short time without causing sporing, then gold-plates the composite film and then seals pores in the aluminum oxide film by immersing the aluminum material coated with the gold-plated composite film in a nickel acetate solution. Accordingly, the amount of gold necessary for giving a predetermined conductivity and corrosion resistance to the aluminum material coated with the composite film is approximately one fiftieth of the amount of gold required for the same purpose, which is advantageous in respect of cost. Furthermore, the method of the present invention is free from faulty plating and is able to achieve qualitatively stable gold-plating.

Figure 7A:
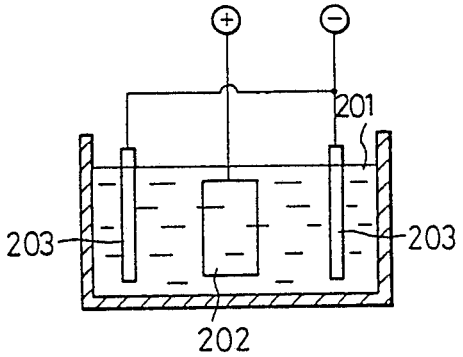
FIGS. 7*a* to 7*e* are illustrations of assistance in explaining a method, in a third embodiment, according to the present invention, showing the process of the method in sequence.

FIG. 7*a* to 7*e* illustrate the processes of a method of forming a composite film over the surface of aluminum materials, in a third embodiment, according to the present invention. As illustrated in FIG. 7*a*, an aluminum material 202 and carbon electrodes 203 are immersed in a sulfuric acid solution 201 having a sulfuric acid concentration in the range of 50 to 80 g/l, and then a voltage of 20 V is applied between the aluminum material 202 as an anode and the carbon electrodes 203 as cathodes. The temperature of the sulfuric acid solution 201 is maintained at 30±2° C. In ten minutes, an aluminum oxide ($Al_2O_3$) film 210 is formed over the surface of the aluminum material 202 as shown in FIG. 8*a*. When observed from above, the aluminum oxide film 210 consists of a plurality of hexagonal cells 210*b* arranged in a honeycomb arrangement, not shown, and each having a pore 211. A barrier 210*a* forming the bottom of each cell 210*b* covers the surface of the aluminum material 202 completely. Each cell 210*b* is approximately 1600 Åin outside diameter, approximately 500 Åin inside diameter, and approximately 10 μm in height.

Figure 8A:
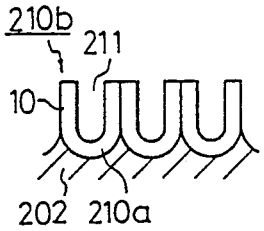
FIGS. 8*a* to 8*f* are illustrations of assistance in explaining the variation of an aluminum oxide film formed over the surface of an aluminum material with the progress of the processes of FIGS. 7*a* to 7*e.*
Figure 8B:
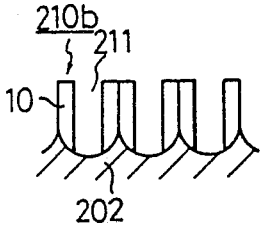

After forming the aluminum oxide film 210, the voltage is dropped sharply from 20 volts to zero, and then a voltage of 0.1 V is applied for ten to fifteen minutes. Consequently, the barriers 210*a* forming the bottoms of the cells 210*b* of the aluminum oxide film 210 are dissolved to allow the pores 211 to connect with the aluminum material 202 as illustrated in FIG. 8*b*.

Figure 7B:
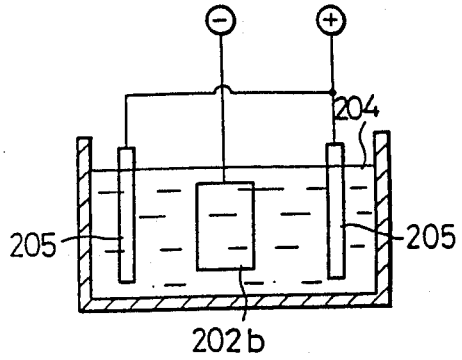
Figure 8C:
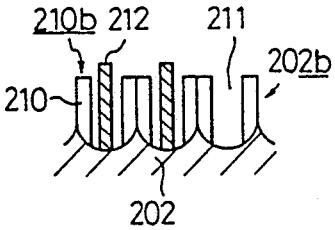

The aluminum material 202 coated with the aluminum oxide film 210 having the bottomless pores 211 is immersed in a nickel-plating solution 204 for nickel-plating employing nickel electrodes 205 as anodes and the aluminum material 202 as a cathodes as illustrated in FIG. 7*b*. During the nickel-plating process, nickel deposits 212 form in the pores 211 in the aluminum oxide film 210 (FIG. 8*c*). The plating voltage is in the range of 0.4 to 1 V, and the current density is in the range of 0.15 to 0.8 A/dm$^2$. During the nickel-plating process, sporing does not occur at all. At the end of the nickel-plating process, the nickel process, the nickel deposits 212 connecting with the aluminum material 202 form over the surfaces of approximately 50% of the cells 210*b* in the aluminum oxide film 210 of the nickel-plated aluminum material 202*b*. Nickel is not deposited at all or is deposited in a thickness less than the height of the cells in the other 50% of the cells 210*b*. The deposition of nickel so that the nickel deposits projects from the surfaces of approximately 50% of the cells 210*b* enables the internal aluminum material coated with the insulating aluminum oxide film 210 to connect electrically with the exterior in a satisfactory condition.

Figure 7C:
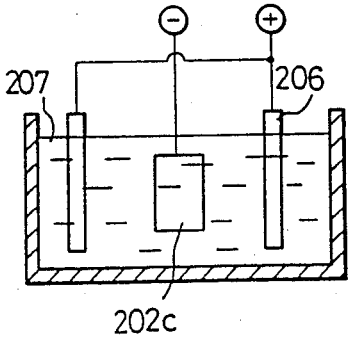
Figure 8D:
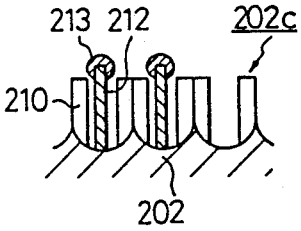

Subsequent to the nickel-plating process, the nickel-plated aluminum material 202*b* is plated with a hard metal such as chromium or rhodium coating (FIG. 7*c*). In FIG. 7*c*, indicated at 206 are anodes such as lead electrodes, and a hard-metal-plating solution at 207. When hard-chromium-plating, for example, is employed, the solution 207 is a mixture of chromic acid and a small amount of sulfuric acid. A hard-metal-plated material 202*c* is produced at the cathode in the solution 207. In the hard-metal-plating process hard-metal deposits 213 form over the top surfaces of the nickel deposits 212 exposed on the surface of the aluminum oxide film 210 as shown in FIG. 8*d*.

Figure 7D:
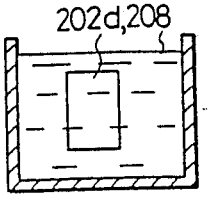
Figure 8E:
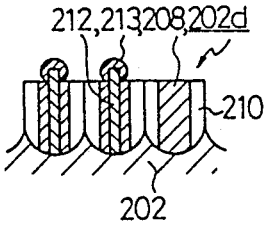

Then, as illustrated in FIG. 7*d*, the hard-metal-plating aluminum material 202*c* is immersed in a dye solution 208 to produce a colored aluminum material 202*d* colored in a desired color. The dye solution 208 is impregnated into the pores 211 of the aluminum oxide film 210 to color the surface of the aluminum oxide film in a desired color (FIG. 8*e*).

Figure 7E:
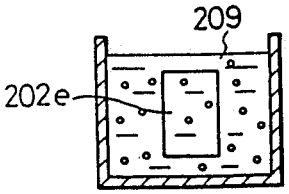
Figure 8F:
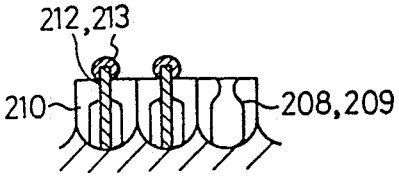

Then, as illustrated in FIG. 7*e*, the colored aluminum material 202*d* is immersed in a sealing solution 209 to obtain a sealed aluminum material 202*e*. The sealing solution is a mixture containing 5 g/l nickel acetate and 5 g/l boric acid. The sealing treatment is carried out at a temperature in the range of 60 to 80° C. in approximately twenty minutes. During the sealing treatment, nickel hydroxide ($Ni(OH)_2$) permeates the cells 210*b* of the aluminum oxide film 210, and thereby corrosion of the surface of the aluminum material is prevented despite the tendency of the combination of aluminum and nickel to form a battery due to great difference in the ionization tendencies of aluminum and nickel. As illustrated in FIG. 8*f*, the sealing treatment causes the surface portions of the cells 210*b* containing nickel hydroxide to expand, so that the pores from which the nickel deposits 212 are projecting are sealed and the openings of the pores from which the nickel deposit is not projecting are narrowed.

It is desirable to complete the sealing by a further sealing treatment using boiling water at 98° C. after the sealing treatment using nickel acetate.

As is apparent from the foregoing description, this method including the hard-metal-plating process and the coloring process according to the present invention, forms a highly corrosion-resistant, conductive composite film composed of aluminum oxide and nickel over an aluminum material in a short time without causing sporing. The composite film can be colored in a desired color without the entire surface being covered with the hard metal plating by plating the tops of the nickel deposits and immersing the aluminum object in a dye solution to impregnate the dye into the pore of the composite film.

We claim:

1. A method of forming a composite aluminum oxide film over an aluminum surface comprising steps of:

forming a porous aluminum oxide film on a surface of an aluminum object by applying to the aluminum object a voltage of 15 to 20 V for 10 to 20 minutes in an acid solution containing 50 to 80 g/l of $H_2SO_4$ at a temperature of 28 to 32° C.;

sharply dropping the voltage to zero at a voltage drop rate sufficient to substantially preclude barrier growth during the voltage dropping period;

applying a voltage of 0.1 V or less to the aluminum material for 10 to 15 minutes to dissolve the aluminum oxide film at the bottoms of the pores;

nickel-plating he aluminum material coated with the aluminum oxide film at a plating voltage of 0.4 to 1 V and a current density of 0.15 to 0.8 A/dm$^2$ to form nickel deposits in the pores of the aluminum oxide film so that the nickel deposits connect electrically with the aluminum material;

plating the top surfaces of the nickel deposits with gold; and sealing the pores of the aluminum oxide film by treating the aluminum oxide film with a sealing solution containing nickel acetate and then treating the aluminum oxide film with boiling water to complete the sealing process.

2. A method of forming a composite film as set forth in claim 1, wherein said aluminum object is an aluminum plate and the aluminum plate is disposed in the nickel-plating solution in the nickel-plating process so that only one surface thereof faces a nickel electrode to form nickel deposits only in said one surface thereof.

3. A method of forming a composite aluminum oxide film over an aluminum surface comprising steps of:

forming a porous aluminum oxide film on a surface of an aluminum object by applying to the aluminum object a voltage of 15 to 20 V for 10 to 20 minutes in an acid solution containing 50 to 80 g/l of $H_2SO_4$ at a temperature of 28 to 32° C.;

sharply dropping the voltage to zero at a voltage drop rate sufficient to substantially preclude barrier growth during the voltage dropping period;

applying a voltage of 0.1 V or less to the aluminum material for 10 to 15 minutes to dissolve the aluminum oxide film at the bottoms of the pores;

nickel-plating the aluminum material coated with the aluminum oxide film at a plating voltage of 0.4 to 1 V and a current density of 0.15 to 0.8 A/dm$^2$ to form nickel deposits in the pores of the aluminum oxide film so that the nickel deposits connect electrically with the aluminum material;

plating the top surface of the nickel deposits with a hard metal;

immersing the aluminum object with the aluminum oxide film having therein nickel deposits coated with a hard metal in a dye solution to thereby impregnate the pores of the aluminum oxide film with the dye solution; and sealing the pores of the aluminum oxide film by treating the aluminum oxide film with a sealing solution containing nickel acetate and then treating the aluminum oxide film with boiling water to complete the sealing process.

4. A method of forming a composite film as set forth in claim 3, wherein said aluminum object is an aluminum plate and the aluminum plate is disposed in the nickel-plating solution in the nickel-plating process so that only one surface thereof faces a nickel electrode to form nickel deposits only in said one surface thereof.

* * * * *

UNITED STATES PATENT AND TRADEMARK OFFICE

CERTIFICATE OF CORRECTION

PATENT NO. : 4,968,389

DATED : November 6, 1990

INVENTOR(S) : KAZUAKI SATOH and KANJI NAGASHIMA

It is certified that error appears in the above-identified patent and that said Letters Patent is hereby corrected as shown below:

TITLE PAGE, [57] ABSTRACT, line 2, "coposite" should be --composite--.

Column 7, lines 9 and 10, should be a continuous sentence.

Column 9, line 54, "Åin" should be --Å in-- (both occurrences);

Column 10, line 27, after "process" insert a comma --,--;

line 31, "hard-metal-plating" should be --hard-metal-plated--.

Signed and Sealed this

Third Day of March, 1992

*Attest:*

*Attesting Officer*

HARRY F. MANBECK, JR.

*Commissioner of Patents and Trademarks*